US007806047B1

(12) United States Patent
Gomez

(10) Patent No.: US 7,806,047 B1
(45) Date of Patent: Oct. 5, 2010

(54) CAN CRUSHING APPARATUS

(76) Inventor: Edward B. Gomez, 937 Citrus Edge St., Azusa, CA (US) 91702

( * ) Notice: Subject to any disclaimer, the term of this patent is extended or adjusted under 35 U.S.C. 154(b) by 390 days.

(21) Appl. No.: 11/954,491

(22) Filed: Dec. 12, 2007

(51) Int. Cl.
*B30B 15/30* (2006.01)

(52) U.S. Cl. ..... 100/216; 100/45; 100/218; 100/902

(58) Field of Classification Search ..... 100/214, 100/215, 216, 218, 269.01, 902, 45, 245
See application file for complete search history.

(56) References Cited

U.S. PATENT DOCUMENTS 2,737,995 A * 3/1956 Jennings ..... 100/269.01
3,055,289 A 9/1962 Komph, Sr.
3,659,520 A * 5/1972 Garrett et al. ..... 100/216
3,817,169 A * 6/1974 Bischoff ..... 100/100
3,835,768 A 9/1974 Kidson
3,907,087 A * 9/1975 Tanaka ..... 194/209
3,916,780 A * 11/1975 Heiser ..... 100/49
4,396,340 A 8/1983 Clinton
4,489,649 A 12/1984 Daugherty
D279,681 S 7/1985 Reynolds
5,417,154 A 5/1995 Plaats
5,778,773 A 7/1998 Clark
5,941,167 A * 8/1999 Fleming ..... 100/45
6,050,181 A * 4/2000 Zenk ..... 100/215

* cited by examiner

*Primary Examiner*—Jimmy T Nguyen

(57) ABSTRACT

A can crushing apparatus includes a base and a receiving bin with an end wall and a pair of side walls extending upwardly from the base. The base has an aperture positioned adjacent to the end wall. A drive assembly is mounted to the base. The drive assembly includes an arm having a free end that extends into the receiving bin and moves toward the end wall when the drive assembly is actuated in a first direction and away from the end wall when the drive assembly is actuated in a second direction. A can is positioned in the receiving bin and crushed between the free end of the arm and the end wall when the drive assembly is actuated in the first direction. The can then falls through the aperture when the drive assembly is actuated in the second direction.

16 Claims, 9 Drawing Sheets

CAN CRUSHING APPARATUS

BACKGROUND OF THE INVENTION

1. Field of the Invention

The present invention relates to can crushing devices and more particularly pertains to a new can crushing device for crushing recyclable cans and the like so that the cans are compact for transportation and storage purposes. The present invention also relates to automated devices for receiving a plurality of cans and systematically crushing the cans.

2. Summary of the Invention

The present invention meets the objectives presented above by generally comprising a base has an upper surface. A receiving bin includes an end wall and a pair of side walls extending upwardly from the upper surface. The side and end walls have an upper edge defining a fill opening into the receiving bin. The base has an aperture therein extending into the upper surface and outwardly of a lower surface of the base. The aperture is positioned adjacent to the end wall. A drive assembly is mounted to the base. The drive assembly includes an arm having a free end that is positioned adjacent to the receiving bin opposite of the end wall. The free end extends into the receiving bin and moves toward the end wall when the drive assembly is actuated in a first direction and away from the end wall when the drive assembly is actuated in a second direction. A can is positioned in the receiving bin and crushed between the free end of the arm and the end wall when the drive assembly is actuated in the first direction. The can then falls through the aperture when the drive assembly is actuated in the second direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
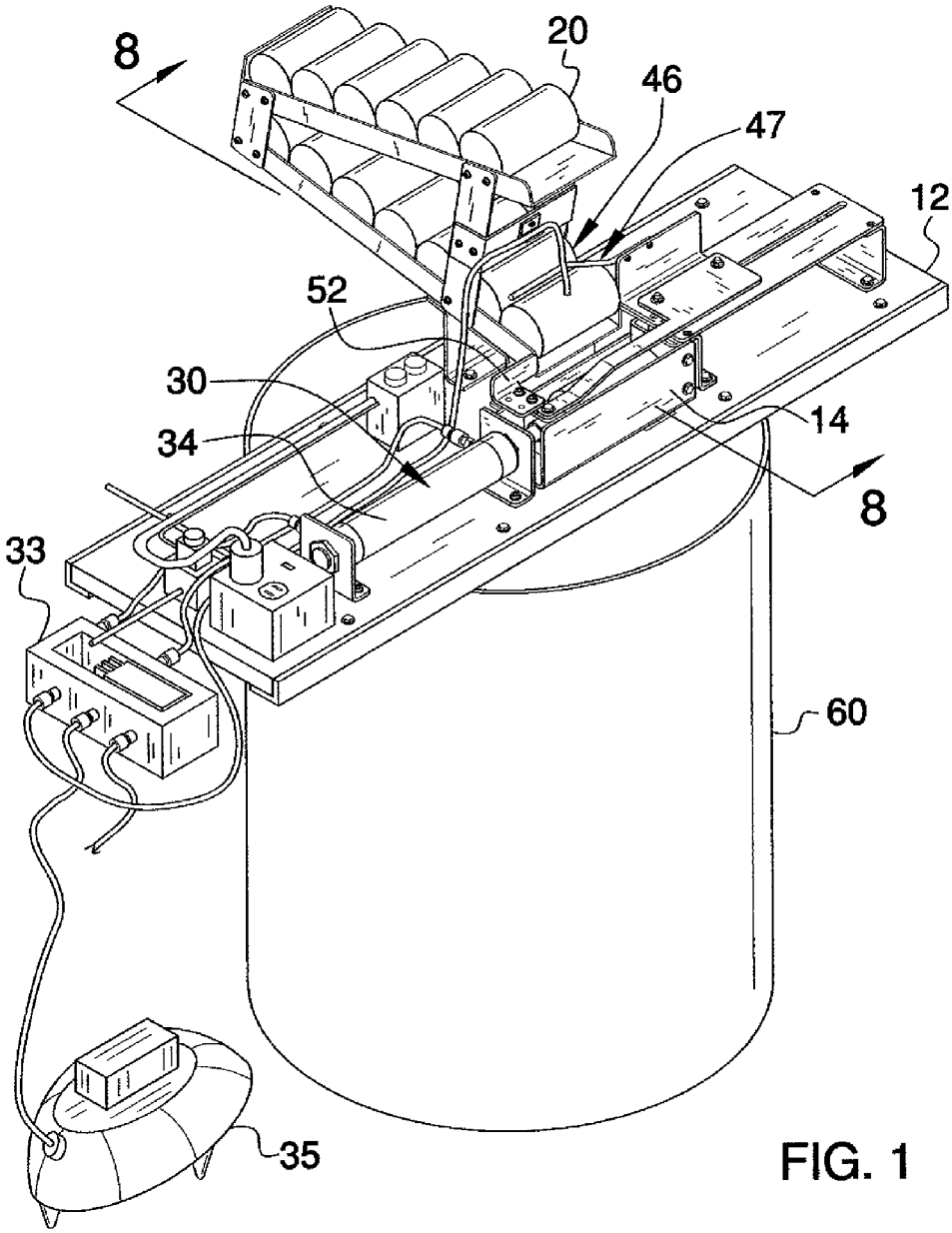
FIG. 1 is a top perspective view of a can crushing apparatus according to the present invention.
Figure 2:
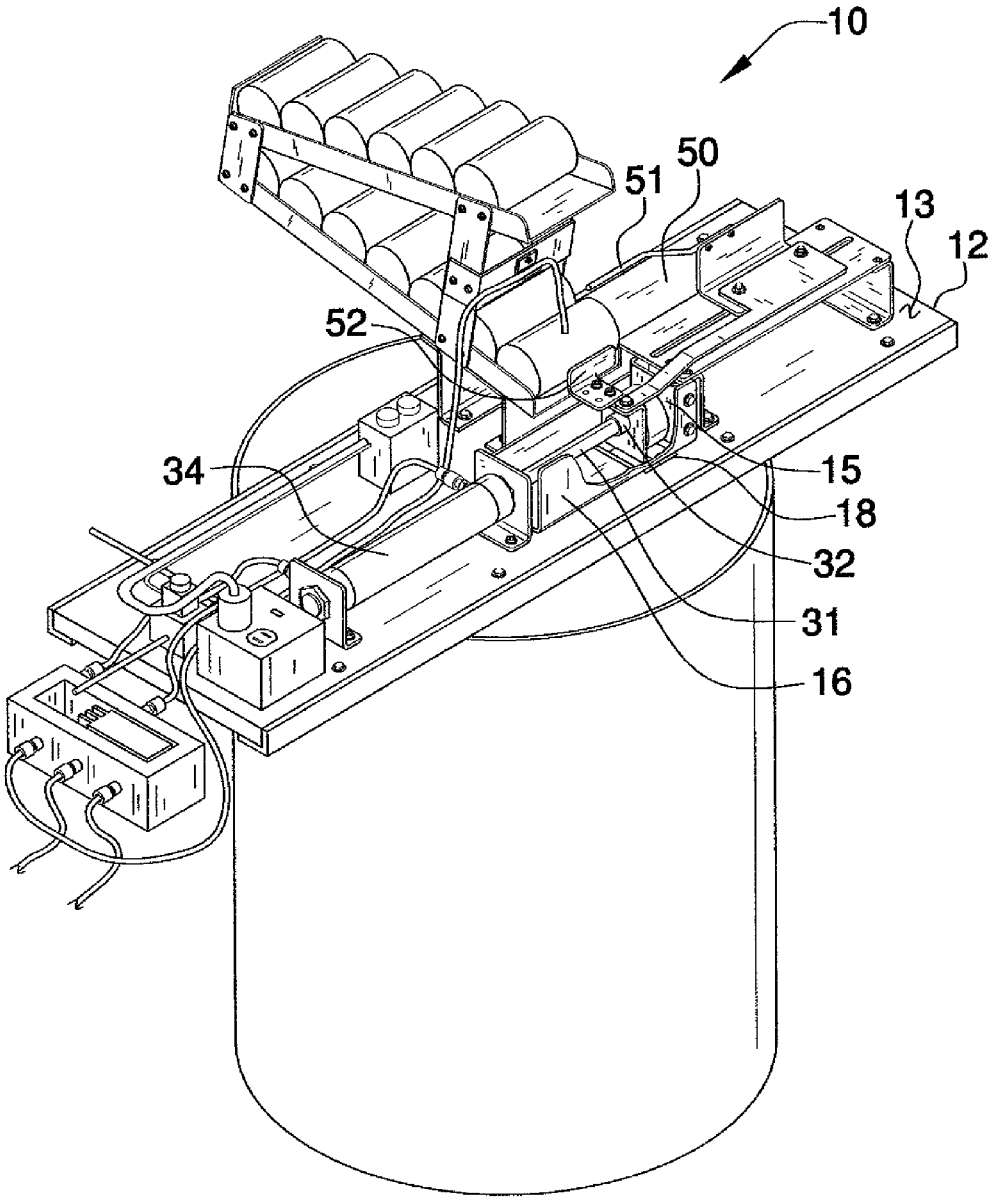
FIG. 2 is a perspective broken view of the present invention.
Figure 3:
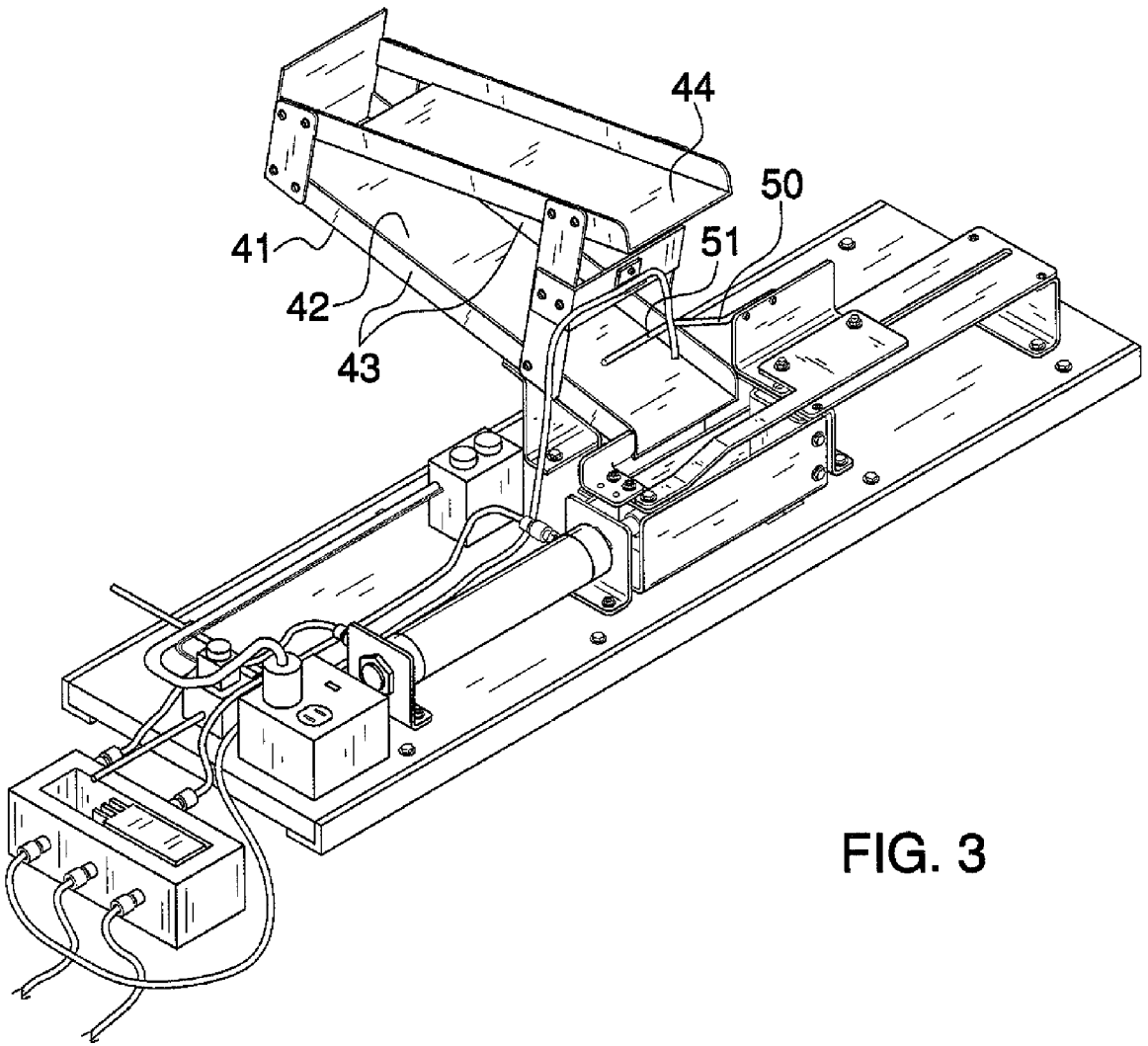
FIG. 3 is an enlarged perspective view of the present invention.
Figure 4:
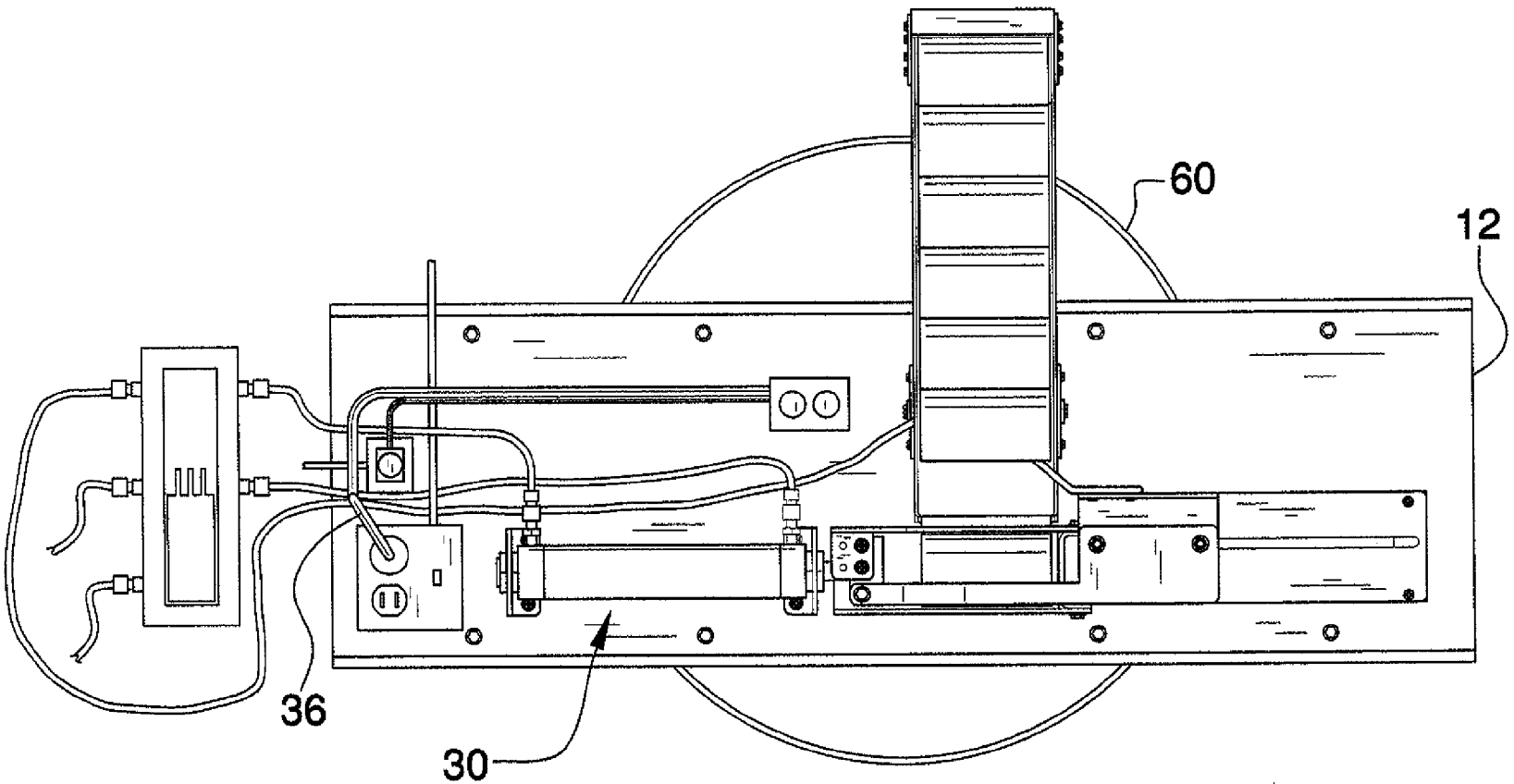
FIG. 4 is a top view of the present invention.
Figure 5:
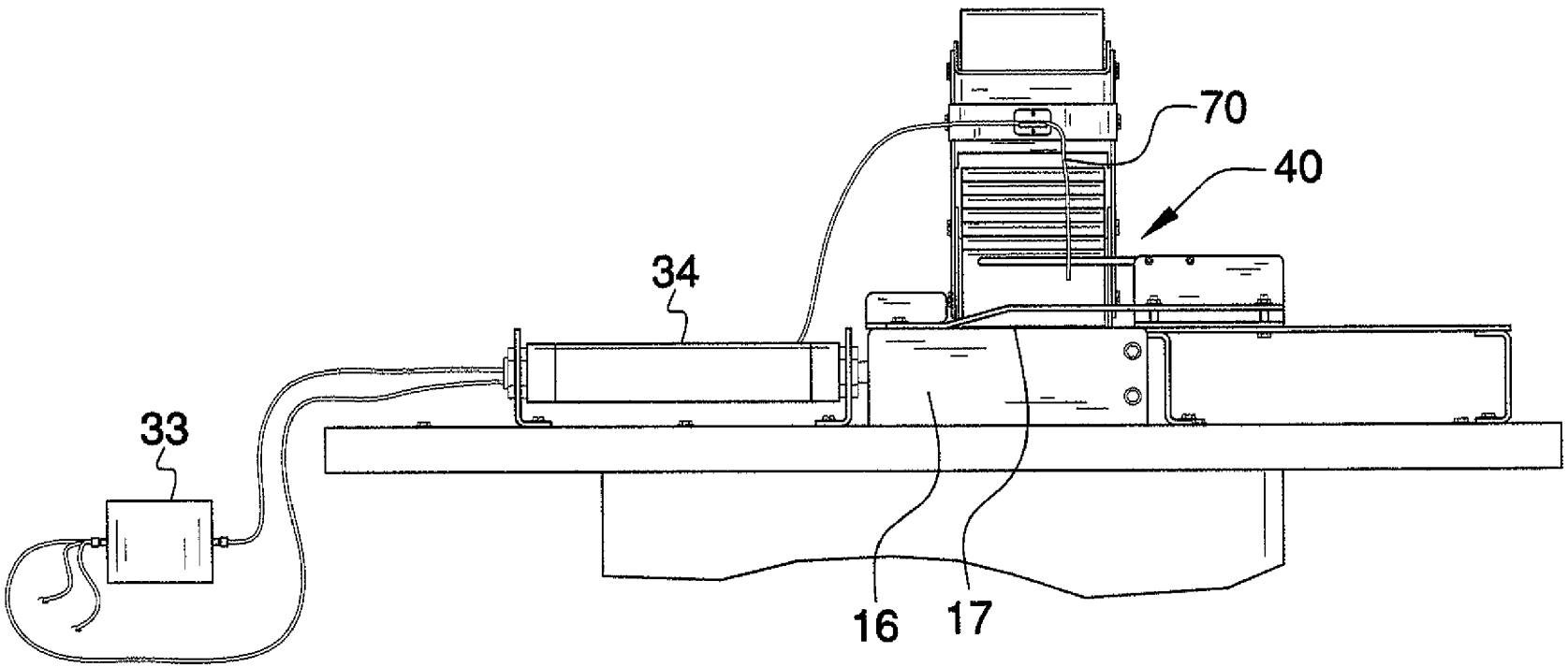
FIG. 5 is a front view of the present invention.
Figure 6:
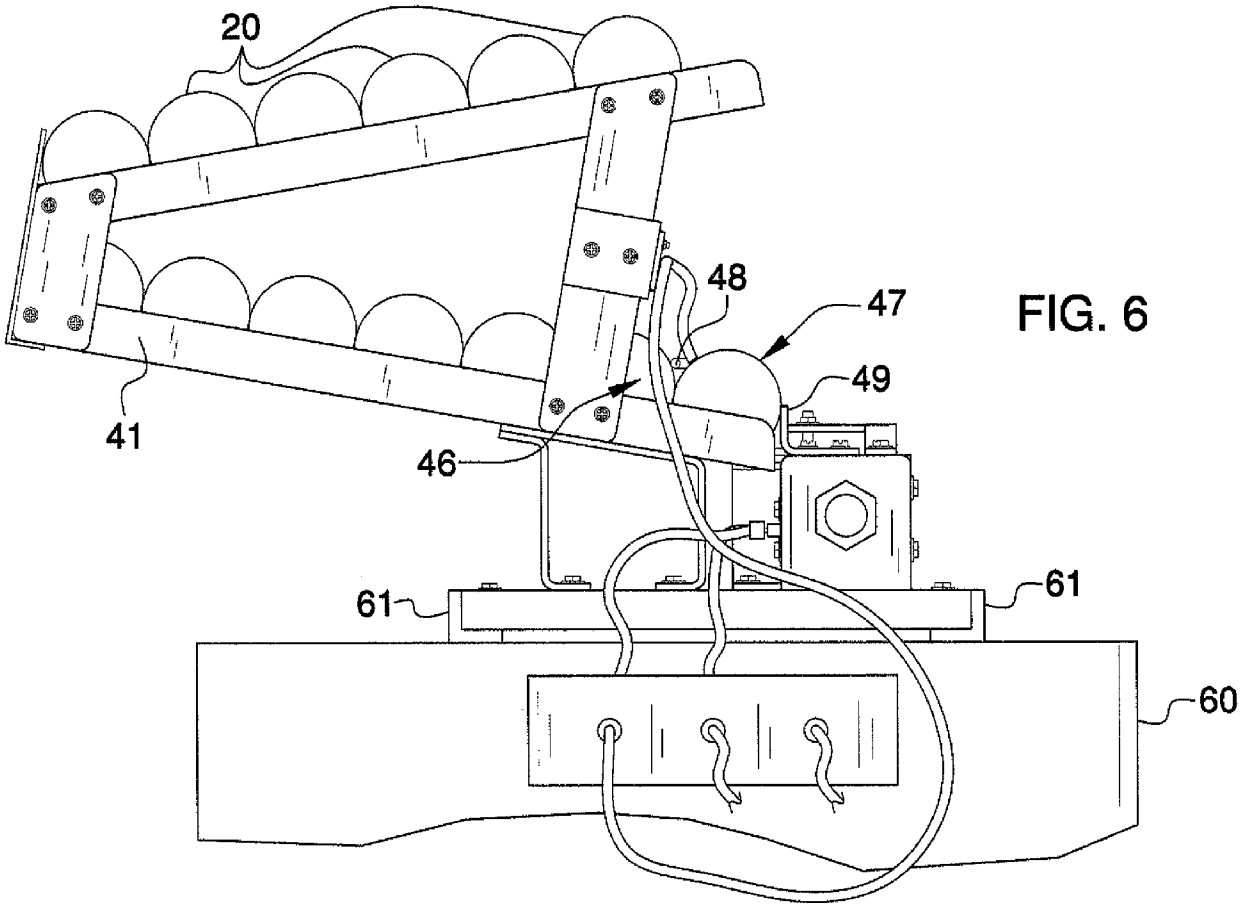
FIG. 6 is a right end view of the present invention.
Figure 7:
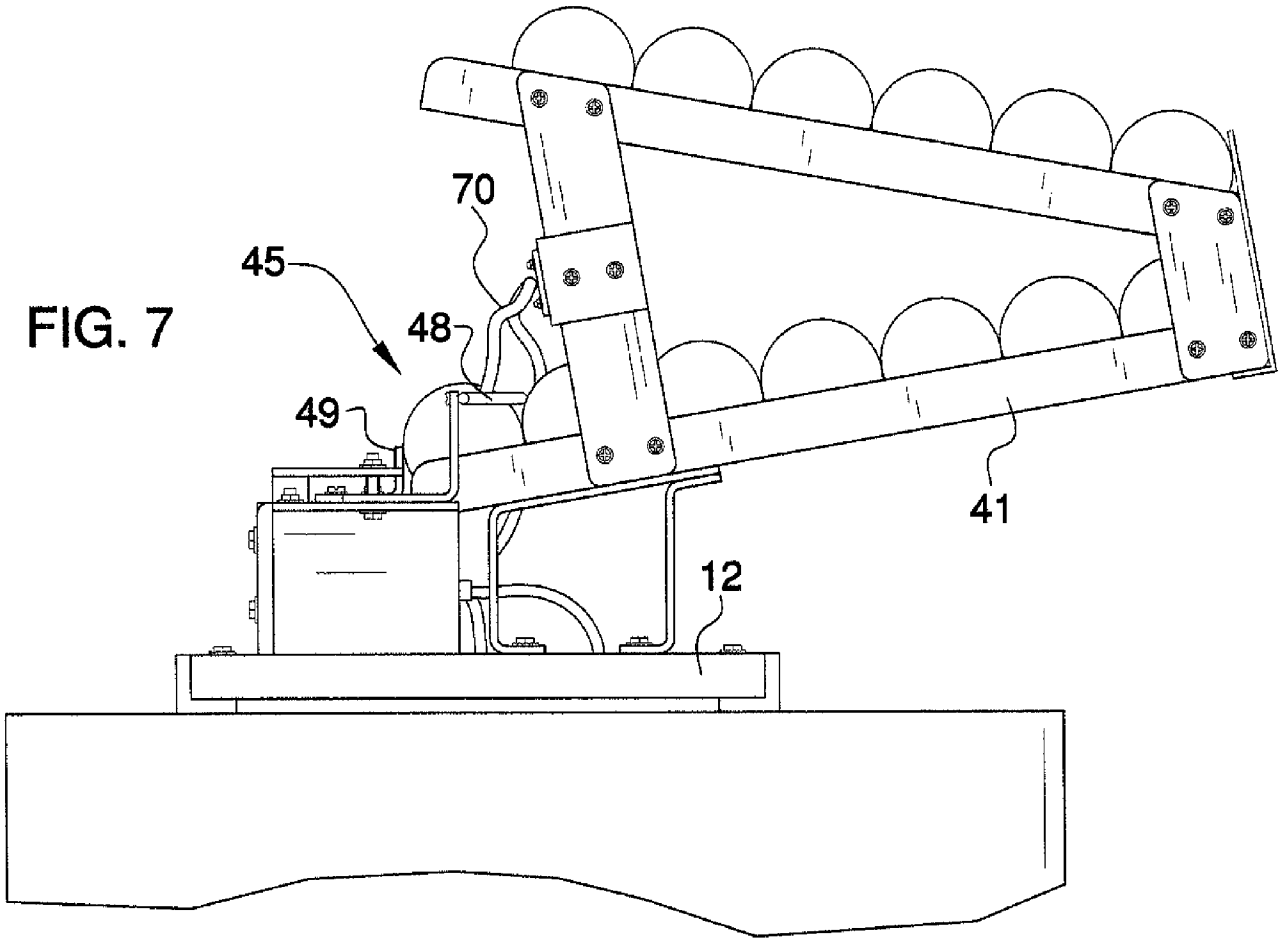
FIG. 7 is a left end view of the present invention.
Figure 8:
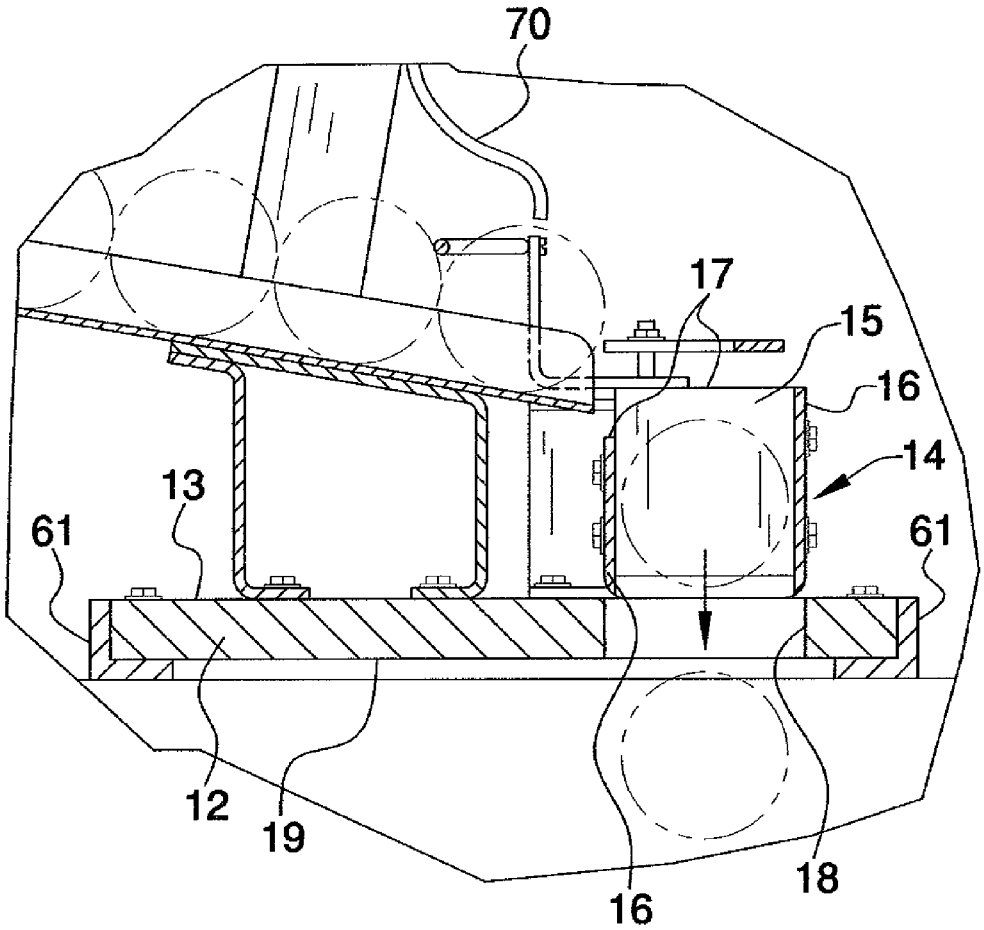
FIG. 8 is a cross-sectional view taken along line 8-8 of FIG. 1 of the present invention.

With reference now to the drawings, and in particular to FIGS. 1 through 9 thereof, a new can crushing device embodying the principles and concepts of the present invention and generally designated by the reference numeral 10 will be described.

As best illustrated in FIGS. 1 through 9, the can crushing apparatus 10 generally comprises a base 12 that has an upper surface 13. A receiving bin 14 includes an end wall 15 and a pair of side walls 16 attached to and extending upwardly from the upper surface 13. The side 16 and end 15 walls have an upper edge 17 defining a fill opening into the receiving bin 14. The base 12 has an aperture 18 therein extending into the upper surface 13 and outwardly of a lower surface 19 of the base 12. The aperture 18 is positioned adjacent to the end wall 15 and has a length and width less than three inches. The side walls 16 are spaced from each other a distance between 2.5 inches and 3.0 inches to conform approximately to the shape and size of a conventional aluminum soda or beer can 20. The aperture 18 extends between the side walls 16 and a distance from the end wall 15 less than 2.0 inches.

Figure 9:
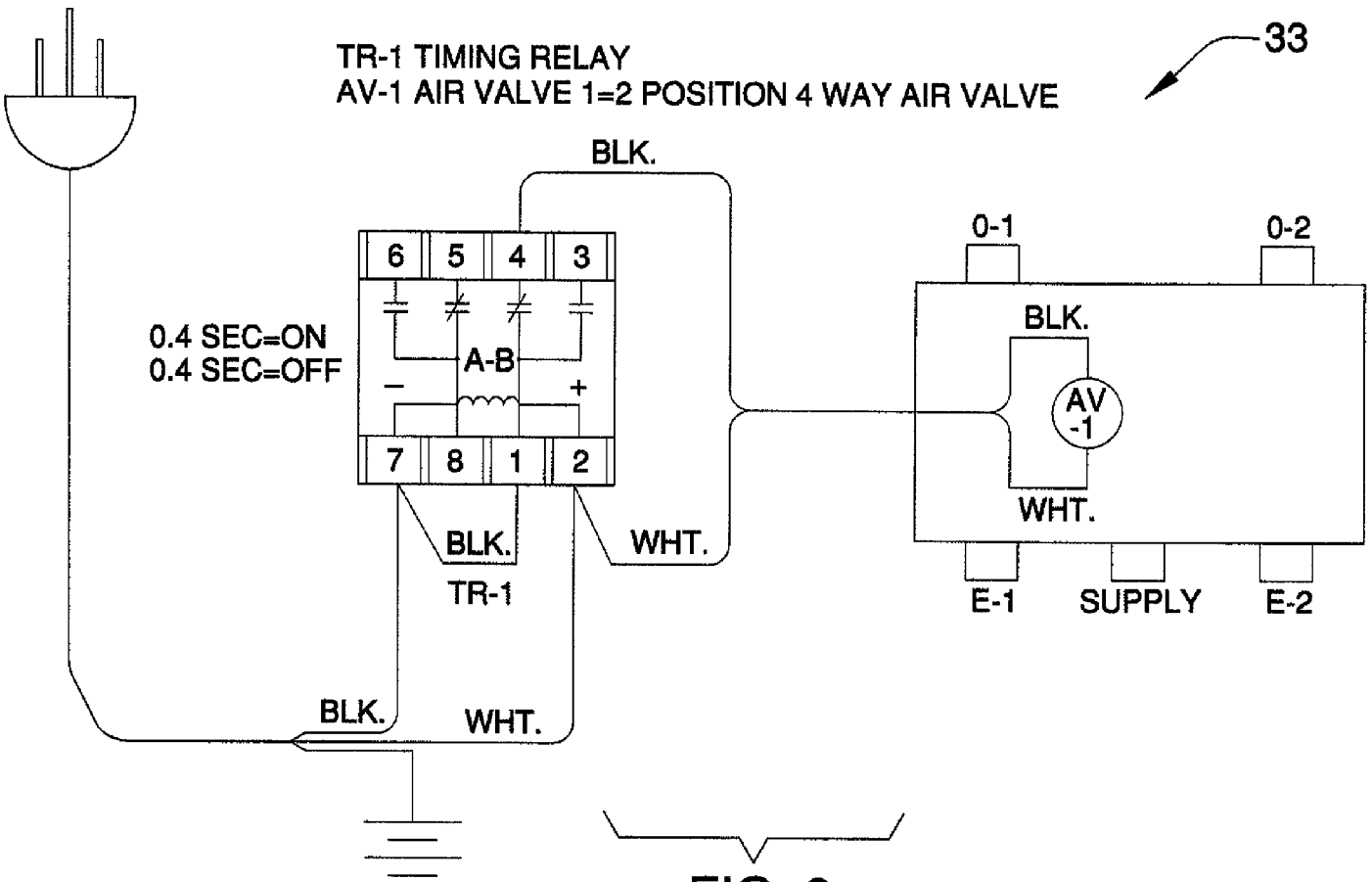
FIG. 9 is an electronic schematic view of the present invention.

A drive assembly 30 is mounted to the base 12. The drive assembly 30 includes an arm 31 that has a free end 32 positioned adjacent to the receiving bin 14 opposite of the end wall 15. The free end 32 extends into the receiving bin 14 and moves toward the end wall 15 when the drive assembly 30 is actuated in a first direction and away from the end wall 15 when the drive assembly 30 is actuated in a second direction. A control 33 is operationally coupled to the drive assembly 30. The control 33 causes the drive assembly 30 to alternately actuate the arm in 31 the first direction and the second direction at selected time intervals. The control 33 may include a valve system fluidly coupled to the drive assembly 30 for pneumatically moving the arm 31, or piston defining the arm, inwardly and outwardly of a cylinder 34. An air compressor 35 may be fluidly coupled to the control 33 to provide pressurized air. FIG. 9 depicts a conventional circuit for timing the actuation of the arm 31. One of a plurality of cans 20 is positioned in the receiving bin 14 and crushed when the drive assembly 30 is actuated in the first direction and falls through the aperture 18 when the drive assembly 30 is actuated in the second direction. The drive assembly 30 is timed to allow another can 20 to fall into the receiving bin 14 after the arm 31 is moved in the second direction and before it moves again into the first position.

A loading assembly 40 is mounted on the base 12 and holds a plurality of the cans 20. The loading assembly 40 deposits the cans 20 into the receiving bin 14 one at a time as the drive assembly 30 is actuated in the second direction. The loading assembly 40 includes a ramp 41 that has a bottom wall 42 and a pair of lateral walls 43. The ramp 41 is angled downwardly toward the receiving bin 14. The cans 20 are positioned on their sides on the bottom wall 42 and roll toward the receiving bin 14. A lengthening member 44 may be attached to the ramp 41 to increase the overall capacity of the ramp 41.

The loading assembly 40 also includes a retaining assembly 45 that is mounted to the arm 31 to allow the cans 20 to fall into the receiving bin 14 one at a time. The retaining assembly 45 controls the movement of the cans 20 from a queued position 46 to a loaded position 47 and then to the receiving bin 14. The loaded position 47 is adjacent to an end of the ramp 41 while the queued position 46 is adjacent to the loaded position 47. The retaining assembly 45 includes a first stop 48 abutting one of the cans 20 in the queued position 46 when the arm 14 is in a retracted position and a second stop 49 abutting one of the cans 20 in the loaded position 47 when the arm 14 is in a fully extended position. The first stop 48 includes a rod that has a first portion 50 extending away from the arm 14 and second portion 51 oriented parallel to a longitudinal axis of the arm 14. The second portion 51 is positioned above the ramp 41 and abuts the can 20 in the queued position 46 when the arm 14 is in the retracted position after the drive assembly 30 has been actuated in the second direction. The second portion 51 moves away from the ramp 41 and releases the can 20 in the queued position 46 to allow it to roll to the loaded position 47. The second stop 49 comprises a plate 52 that is attached to and extends upwardly from the arm 14. The plate 52 abuts the can 20 in the loaded position 47 when the arm 14 is in the extended position after the drive assembly 30 has been actuated in the second direction. The plate 52 moves away from the ramp 41 and releases the can 20 in the loaded position 47 to allow it to roll into the receiving bin 14.

A container 60 is positioned under the base 12. The container 60 receives the cans 20 after the cans 20 have been crushed and fallen through the aperture 18. Supports 61 may be attached to and extended along the edges of the base 12 to support the base 12 on the container 60.

An urging member 70 urges cans 20 from the load assembly 40 and into the receiving bin 14. The urging member 70 includes a hose positioned over the loaded position 47 and directing air downward toward the loaded position 47 and the receiving bin 14. The urging member 70 also prevents the cans 20 from bouncing out of the receiving bin 14 after they fall into the receiving bin 14 from the ramp 41.

In use, a person loads the ramp 41 and turns on the control 33 to start the process of the arm 31 being moved back and forth as described above. When the arm 31 retracts one of the cans 20 falls into the bin 14 and is subsequently crushed when the arm 31 extends. After the can 20 is crushed, it has a small enough size to fall through the aperture 18 and into the container 60 for collection. The crushed cans 20 are then recycled. The control 33 includes an on/off switch 36 for selectively turning the control on or off. When the switch 36 is placed in an on position, the arm 14 will begin to move back and forth, alternating between dropping cans 20 into the receiving bin 14 and crushing the cans 20.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A can crushing apparatus for holding and crushing a plurality of cans, said apparatus comprising:

a base having an upper surface;

a receiving bin including an end wall and a pair of side walls extending upwardly from said upper surface, said side and end walls having an upper edge defining a fill opening into said receiving bin, said base having an aperture therein extending into said upper surface and outwardly of a lower surface of said base, said aperture being positioned adjacent to said end wall;

a drive assembly being mounted to said base, said drive assembly including an arm having a free end, said free end being positioned adjacent to said receiving bin opposite of said end wall, said free end extending into said receiving bin and moving toward said end wall when said drive assembly is actuated in a first direction and away from said end wall when said drive assembly is actuated in a second direction;

a loading assembly being mounted on said base and holding a plurality of the cans, said loading assembly depositing the cans into the receiving bin one at a time for each actuation of said drive assembly in said second direction, said loading assembly including;

a ramp having a bottom wall and a pair of lateral walls, said ramp being angled downwardly toward said receiving bin, said cans being positioned on their sides on said bottom wall and rolling toward said receiving bin;

a retaining assembly being mounted to said arm to allow said cans to fall into said receiving bin one at a time, said retaining assembly controlling the movement of said cans from a queued position to a loaded position and then to the receiving bin, said loaded position being adjacent to an end of said ramp, said retaining assembly including a first stop abutting one of said cans in said queued position when said arm is in a retracted position and a second stop abutting one of said cans in said loaded position when said arm is in a fully extended position; and wherein one of the cans is positioned in the receiving bin and crushed when said drive assembly is actuated in said first direction and falls through said aperture when said drive assembly is actuated in said second direction.

2. The apparatus according to claim 1, wherein said side walls are spaced from each other a distance between 2.5 inches and 3.0 inches, said aperture extending between said side walls and a distance from said end wall less than 2.0 inches.

3. The apparatus according to claim 1, wherein said first stop includes a rod having a first portion extending away from said arm and second portion oriented parallel to a longitudinal axis of said arm, said second portion being positioned above said ramp and abutting the can in said queued position when said arm is in said retracted position after said drive assembly has been actuated in said second direction, said second portion moving away from said ramp and releasing the can in said queued position to said loaded position.

4. The apparatus according to claim 3, wherein said second stop comprises a plate being attached to and extending upwardly from said arm, said plate abutting the can in the loaded position when said arm is in said extended position after said drive assembly has been actuated in said second direction, said plate moving away from said ramp and releasing the can in said loaded position to said receiving bin.

5. The apparatus according to claim 1, further including a control being operationally coupled to said drive assembly, said control causing said drive assembly to alternately actuate said arm in said first direction and said second direction at selected time intervals.

6. The apparatus according to claim 1, further including a container being positioned under said base, said container receiving the cans after the cans have been crushed and fallen through said aperture.

7. The apparatus according to claim 1, further including an urging member urging cans from said load assembly and into said receiving bin.

8. The apparatus according to claim 7, wherein said urging member includes a hose positioned over the loaded position and directing air downward toward the loaded position and said receiving bin.

9. A can crushing apparatus for holding and crushing a plurality of cans, said apparatus comprising:

a base having an upper surface;

a receiving bin including an end wall and a pair of side walls extending upwardly from said upper surface, said side and end walls having an upper edge defining a fill opening into said receiving bin, said base having an aperture therein extending into said upper surface and outwardly of a lower surface of said base, said aperture being positioned adjacent to said end wall and having a length and width less than three inches, said side walls being spaced from each other a distance between 2.5 inches and 3.0 inches, said aperture extending between said side walls and a distance from said end wall less than 2.0 inches;

a drive assembly being mounted to said base, said drive assembly including an arm having a free end, said free end being positioned adjacent to said receiving bin opposite of said end wall, said free end extending into said receiving bin and moving toward said end wall when said drive assembly is actuated in a first direction and away from said end wall when said drive assembly is actuated in a second direction;

wherein one of the cans is positioned in the receiving bin and crushed when said drive assembly is actuated in said first direction and falls through said aperture when said drive assembly is actuated in said second direction;

a loading assembly being mounted on said base and holding a plurality of the cans, said loading assembly depositing the cans into the receiving bin one at a time as said drive assembly is actuated in said second direction, said loading assembly including;

a ramp having a bottom wall and a pair of lateral walls, said ramp being angled downwardly toward said receiving bin, said cans being positioned on their sides on said bottom wall and rolling toward said receiving bin;

a retaining assembly being mounted to said arm to allow said cans to fall into said receiving bin one at a time, said retaining assembly controlling the movement of said cans from a queued position to a loaded position and then to the receiving bin, said loaded position being adjacent to an end of said ramp, said retaining assembly including a first stop abutting one of said cans in said queued position when said arm is in a retracted position and a second stop abutting one of said cans in said loaded position when said arm is in a fully extended position, said first stop including a rod having a first portion extending away from said arm and second portion oriented parallel to a longitudinal axis of said arm, said second portion being positioned above said ramp and abutting the can in said queued position when said arm is in said retracted position after said drive assembly has been actuated in said second direction, said second portion moving away from said ramp and releasing the can in said queued position to said loaded position, said second stop comprising a plate being attached to and extending upwardly from said arm, said plate abutting the can in the loaded position when said arm is in said extended position after said drive assembly has been actuated in said second direction, said plate moving away from said ramp and releasing the can in said loaded position to said receiving bin;

a control being operationally coupled to said drive assembly, said control causing said drive assembly to alternately actuate said arm in said first direction and said second direction at selected time intervals;

a container being positioned under said base, said container receiving the cans after the cans have been crushed and fallen through said aperture; and an urging member urging cans from said load assembly and into said receiving bin, said urging member including a hose positioned over the loaded position and directing air downward toward the loaded position and said receiving bin.

10. A can crushing apparatus for holding and crushing a plurality of cans, said apparatus comprising:

a base having an upper surface;

a receiving bin including an end wall and a pair of side walls extending upwardly from said upper surface, said side and end walls having an upper edge defining a fill opening into said receiving bin, said base having an aperture therein extending into said upper surface and outwardly of a lower surface of said base, said aperture being positioned adjacent to said end wall;

a drive assembly being mounted to said base, said drive assembly including an arm having a free end, said free end being positioned adjacent to said receiving bin opposite of said end wall, said free end extending into said receiving bin and moving toward said end wall when said drive assembly is actuated in a first direction and away from said end wall when said drive assembly is actuated in a second direction;

a loading assembly being mounted on said base and holding a plurality of the cans, said loading assembly depositing the cans into the receiving bin one at a time for each actuation of said drive assembly in said second direction, said loading assembly including;

a ramp having a bottom wall and a pair of lateral walls, said ramp being angled downwardly toward said receiving bin, said cans being positioned on their sides on said bottom wall and rolling toward said receiving bin;

a retaining assembly being mounted to said arm to allow said cans to fall into said receiving bin one at a time, said retaining assembly controlling the movement of said cans from a queued position to a loaded position and then to the receiving bin, said loaded position being adjacent to an end of said ramp;

an urging member urging cans from said load assembly and into said receiving bin, said urging member including a hose positioned over the loaded position and directing air downward toward the loaded position and said receiving bin;

wherein one of the cans is positioned in the receiving bin and crushed when said drive assembly is actuated in said first direction and falls through said aperture when said drive assembly is actuated in said second direction.

11. The apparatus according to claim 10, wherein said side walls are spaced from each other a distance between 2.5 inches and 3.0 inches, said aperture extending between said side walls and a distance from said end wall less than 2.0 inches.

12. The apparatus according to claim 10, wherein said retaining assembly includes a first stop abutting one of said cans in said queued position when said arm is in a retracted position and a second stop abutting one of said cans in said loaded position when said arm is in a fully extended position.

13. The apparatus according to claim 12, wherein said first stop includes a rod having a first portion extending away from said arm and second portion oriented parallel to a longitudinal axis of said arm, said second portion being positioned above said ramp and abutting the can in said queued position when said arm is in said retracted position after said drive assembly has been actuated in said second direction, said second portion moving away from said ramp and releasing the can in said queued position to said loaded position.

14. The apparatus according to claim 13, wherein said second stop comprises a plate being attached to and extending upwardly from said arm, said plate abutting the can in the loaded position when said arm is in said extended position after said drive assembly has been actuated in said second direction, said plate moving away from said ramp and releasing the can in said loaded position to said receiving bin.

15. The apparatus according to claim 10, further including a control being operationally coupled to said drive assembly, said control causing said drive assembly to alternately actuate said arm in said first direction and said second direction at selected time intervals.

16. The apparatus according to claim 10, further including a container being positioned under said base, said container receiving the cans after the cans have been crushed and fallen through said aperture.

* * * * *